US007133640B2

(12) United States Patent
Zeller et al.

(10) Patent No.: US 7,133,640 B2
(45) Date of Patent: Nov. 7, 2006

(54) STAPLER/STACKER FOR FRONT-ORIENTED FRONT-ACCESS PRINTERS

(75) Inventors: Sarah Zeller, Boise, ID (US); Michael Lloyd, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 92 days.

(21) Appl. No.: 10/629,398

(22) Filed: Jul. 29, 2003

(65) Prior Publication Data

US 2005/0025545 A1 Feb. 3, 2005

(51) Int. Cl.
*G03G 15/00* (2006.01)

(52) U.S. Cl. ..... 399/410; 399/401

(58) Field of Classification Search ..... 399/393, 399/364, 400–405, 407, 410, 397, 41
See application file for complete search history.

(56) References Cited

U.S. PATENT DOCUMENTS 4,424,963 A * 1/1984 Bartholet et al. ..... 270/58.13
4,934,681 A * 6/1990 Holmes et al. ..... 271/3.18
5,303,017 A * 4/1994 Smith ..... 399/403
5,769,404 A * 6/1998 Kanou et al. ..... 270/37
5,974,283 A * 10/1999 Cho ..... 399/75
6,263,185 B1 * 7/2001 Kato et al. ..... 399/381
6,353,727 B1 * 3/2002 Muraoka et al. ..... 399/410
6,445,903 B1 * 9/2002 Hashimoto et al. ..... 399/401
6,641,129 B1 * 11/2003 Ogita et al. ..... 270/58.08
6,690,901 B1 * 2/2004 Katsuyama et al. ..... 399/107
2002/0131802 A1 * 9/2002 Shimizu et al. ..... 399/405
2002/0159805 A1 * 10/2002 Sato ..... 399/405

* cited by examiner

*Primary Examiner*—Anthony H. Nguyen

(57) ABSTRACT

A front-oriented, front-access printer (FOFAP) is disclosed, the FOFAP configured with a front-mounted fuser, the FOFAP comprising a print mechanism, a main paper path passing through both the print mechanism and the fuser, a media flipper for directing the paper into a duplex path, a stapler/stacker mounted in proximity to the front-mounted fuser, and a redirector within the front-mounted fuser for redirecting the paper from the duplex path to the stapler/stacker in response to selection of a staple/stacking feature.

17 Claims, 5 Drawing Sheets

STAPLER/STACKER FOR FRONT-ORIENTED FRONT-ACCESS PRINTERS

FIELD OF THE INVENTION

The present invention relates, in general, to printing devices, and, more particularly, to stapler/stackers in printing devices.

DESCRIPTION OF RELATED ART

With advancements in printing technology, many features and elements of printing, which formerly were only available on large-scaled, expensive printers, are now available on desktop printing models. Two such features are stapling and offset stacking. Stapling is generally implemented by incorporating a stapler into the printer. Print jobs that are designated for stapling are typically re-routed to a path that feeds a stacker or collection area in proximity to the stapler and, which accumulates the pages and then staples the completed copy.

Offset stacked print jobs are typically used with or without stapling to stack one complete copy or print job on top of another complete copy or print job with a slight offset in the output bin in order to make separating the copies easier for the user. Alternatively, instead of placing a complete copy or print job offset against subsequent copies, all copies of each page may be offset against one another. Again, print jobs designated for offset stacking are typically re-routed to a path that facilitates collecting or accumulating all of the pages of the copy job and then outputting the copy through offset joggers that will systematically allow each separate copy to be placed in the output bin on top of the previous copy with a slight physical offset. Joggers are generally sets of arms in printing systems that typically hold the print media on each edge. The arms can sometimes translate from side-to-side in order to offset the particular print or copy job. Joggers also may typically move closer and further apart to accommodate various media widths. Because both features, stapling and offset stacking, generally use a stacker to collect or accumulate all of the pages of a copy set before either stapling or offsetting, these features have generally been combined into a stapler/stacker in the different printing configurations.

Before examining such example printer configurations, it may be helpful to address one basic operation arrangement of a typical laser printer. FIG. 1 is a schematic diagram of one embodiment of a laser printer, designated by reference number 101. In general, and referring to FIG. 1, a computer transmits data representing an image to input port 102 of printer 101. This data is analyzed in formatter 103. Formatter 103 may include a microprocessor, a related programmable memory and a page buffer. Formatter 103 formulates and stores an electronic representation of each page to be printed. Once a page has been formatted, the electronic representation of each page may be transmitted to the page buffer. The page buffer breaks the electronic page into a series of lines one dot wide. This line of data is sent to the printer controller 104. Controller 104, which also preferably includes a microprocessor and programmable memory, drives laser 105 and controls the drive motor or motors, fuser temperature and pressure, and the other print engine components and operating parameters.

Each line of data is used to modulate the light beam produced by laser 105. The light beam is reflected off a multifaceted spinning mirror 106. As each facet of mirror

106 spins through the light beam, it reflects or "scans" the beam across the side of a photoconductive drum 107. Photoconductive drum 107 rotates just enough that each successive scan of the light beam is recorded on drum 107 immediately after the previous scan. In this manner, each line of data is recorded on photoconductive drum 107. Toner is electrostatically transferred from developing roller 109 onto photoconductive drum 107 according to the data previously recorded on the drum. The toner is thereafter transferred from photoconductive drum 107 onto media 110 (e.g., paper) as media 110 passes between drum 107 and pressure roller 111. Drum 107 is cleaned of excess toner with cleaning blade 113. Drum 107 may be completely discharged by discharge lamps 114 before a uniform charge is restored to drum 107 by charging roller 108 in preparation for the next toner transfer.

Each sheet of media 110 is advanced to the photoconductive drum 107 by a pick/feed mechanism 116. Pick/feed mechanism 116 includes motor driven feed roller 117 and registration rollers 122. A paper stack 118 is positioned in input tray 119 to allow sliding passage of the top sheet of media 110 into pick/feed area 115 at the urging of feed roller 117. In contacts the upper surface of media 110 and pulls it into pick/feed area 115. As the leading edge of media 110 moves through pick/feed area 115, it is engaged between the pair of registration rollers 122. A ramp 123 helps guide media 110 into registration rollers 122. Registration rollers 122 advance media 110 along the media travel path 120 until it is engaged between drum 107 and pressure roller 111 where toner is applied to the paper as described above.

Once the toner is applied to media 110, it is advanced along the paper path to fuser 112. Fuser 112 includes a heated fusing roller 124 and a pressure roller 125. As the paper passes between the rollers, toner is fused to the paper through a process of heat and pressure. Heated fusing roller 124 is heated by heating element 126.

Returning to one particular printer configuration, a front-oriented, front access, face-down media output pathway from the user, and a fusing system with media flipper located in the top-front portion of the printer (FOFAP), several different combined stapler/stacker system implementations have been attempted. FIG. 2 is a side view of FOFAP 20 with front-mounted print system 206, fuser 201, and stapler/stacker 203. In this embodiment of FOFAP 20, on print activation, the paper follows main paper path 200 to print system 206 and then fuser 201. In regular printing jobs, the final print product is output into main high-capacity (HiCap) output bin 202. However, when a staple function or offset function is selected, the paper is re-directed into stapler/stacker assembly 203. The collection of pages of the print job takes place in stapler/stacker assembly 203 until all pages are collected. Once collected, the job is either stapled or offset, depending on the feature selected, and output onto stapler/stacker output tray 205 via joggers 204.

The configuration of the front-mounted flipper and stapler/stacker shown for FOFAP 20 generally requires either that the user access the output from the side of the printer, which causes a usability issue, or that the printer be oriented sideways, which typically costs more and takes up more space on a desktop. Furthermore, stapler/stacker assembly 203 with joggers 204 and stapled/offset output tray 205 generally blocks front and top access to main HiCap output bin 202 and also may block access to any access doors for maintenance. This configuration of stapler/stacker assembly 203 also adds significant height to FOFAP 20.

FIG. 3 is a side-view of FOFAP 30 configured with front-mounted printing apparatus 307, fuser 301, rear-mounted flipper 303, and rear-mounted stapler/stacker assembly 304. In operation, paper is fed along main paper path 300 through print mechanism 307 and fuser 301. In normal print jobs, the printed product is output onto primary output bin 302. If either the staple or offset feature is utilized, fuser 301 instead directs the paper to flipper 303 to be flipped into stapler/stacker 304, in order to maintain the face-down output orientation of the stapled or offset product. The pages of the print job are collected in stapler/stacker 304 during the printing process. As the copy is completed, stapler/stacker either staples or offsets the output copy onto joggers 305 to correctly place the stapled or offset printed copy onto offset output bin 306 in a face-down orientation.

The configuration of FOFAP 30 generally requires an additional media flipper, flipper 303, to achieve face-down stacking due to the shape of the paper path. Furthermore, rear-mounted stapler/stacker 304 generally adds significant height to FOFAP 30. The depth of FOFAP 30 would also likely require an increase in order to facilitate use of longer sized papers, such as legal, A4, and the like, due to the positioning of rear-mounted stapler/stacker 304. Because stapler/stacker 304 lies at the end of primary output bin 302, the leading edge of output pages may impact stapler/stacker 304 causing buckling or bending of the output media. Moreover, even if primary output bin 302 was long or deep enough, the output to primary output bin 302 and offset output bin 306 would be facing different directions, which may be non-intuitive to a user, thus, causing confusion. Also, because of the placement of flipper 303 and stapler/stacker 304 in relation to fuser 301 is relatively far, there is likely to be reduced performance for first-page-out time in addition to reduced overall performance (speed) for all jobs. Moreover, because each page typically has to wait for each previous page to be completely turned over in flipper 303, performance is further slowed.

BRIEF SUMMARY OF THE INVENTION

Representative embodiments of the present invention are directed to a front-oriented, front-access printer (FOFAP), the FOFAP configured with a front-mounted fuser, the FOFAP comprising a print mechanism, a main paper path passing through both the print mechanism and the fuser, a media flipper for directing the paper into a second path, a stapler/stacker mounted in proximity to the front-mounted fuser, and a redirector within the front-mounted fuser for redirecting the paper from the second path to the stapler/stacker in response to selection of a staple/stacking feature.

Further representative embodiments of the present invention are directed to a method for redirecting print media to a front-mounted stapler/stacker assembly in a front-oriented, front-access printer (FOFAP) having a front-mounted fusing apparatus, the method comprising directing the print media through a print system, guiding the print media through a fusing apparatus after the print system, and re-directing the print media from an alternative path to the front-mounted stapler/stacker assembly using an existing media flipper for the alternative path, the re-directing being responsive to receiving a signal to perform a staple/offset function.

Additional representative embodiments of the present invention are directed to a printer having staple/offset stack features, the printer being front-oriented, front-access oriented, the printer comprising printing means, fusing means mounted in a front area of the printer, media flipping means for directing the print media into a second printing path, stacking means mounted in a front side of the printer for accumulating the print media pending execution of a staple/offset function, and redirection means utilizing the media flipping means to deflect the print media into the stacking means in response to selection of the staple/offset stack capability.

DETAILED DESCRIPTION

Figure 4:
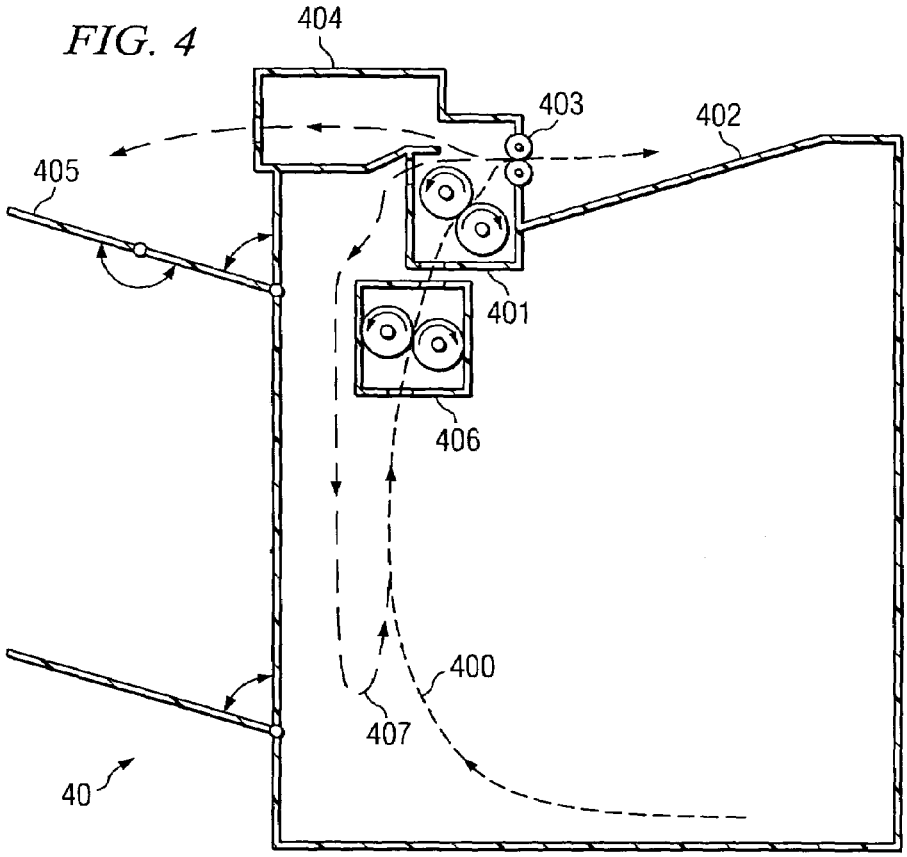
FIG. 4 is a side view of one embodiment of a FOFAP configured with a front-mounted fusing system and a front mounted stapler/stacker integrated into the top front portion of the FOFAP.

FIG. 4 is a side view of one embodiment of FOFAP 40 configured with front-mounted print mechanism 406, front-mounted fusing system 401, and front-mounted stapler/stacker 404 integrated into the top front portion of FOFAP 40. In operation, pages that are to be stapled or offset are directed from main paper path 400 to stapler/stacker device 404 by redirecting the pages using media flipper 403. Media flipper 403 exists originally in FOFAP 40 for duplex printing. When the staple/offset printing feature is selected the paper begins exiting through media flipper 403. However, when the trailing edge of the paper exits fuser 401, media flipper 403 reverses direction, pulling the paper back into FOFAP 40. Instead of directing the paper into duplex paper path 407, the page is directed into stapler/stacker 404. Pages are accumulated in stapler/stacker device 404 until the copy is complete. Depending on the operation selected the copy is either stapled or offset into folding offset output tray 405. Folding offset output tray 405 does not obscure primary output 402 and may be folded away by the user, decreasing the effective footprint of FOFAP 40.

Figure 1:
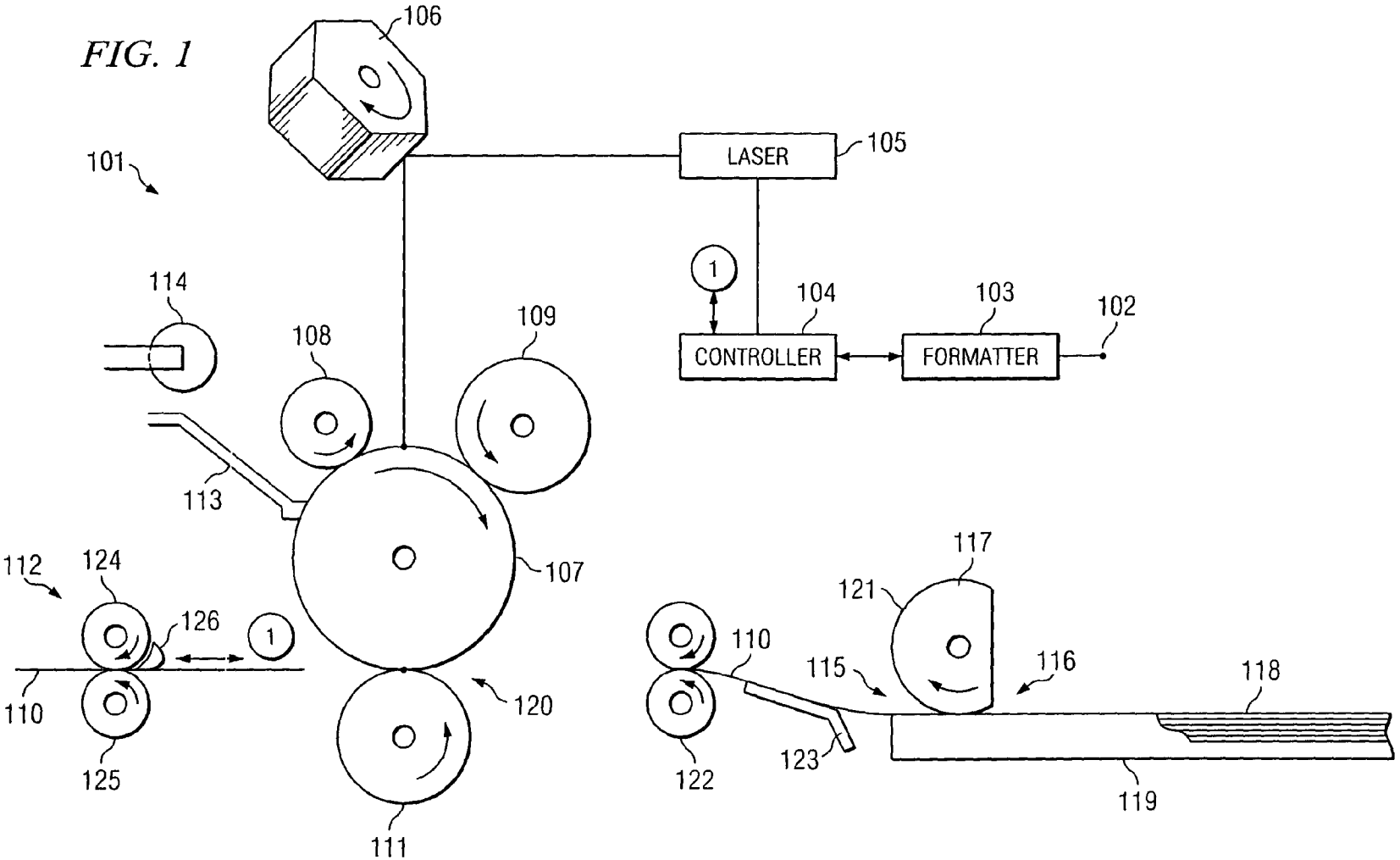
FIG. 1 is a schematic diagram of one embodiment of a laser printing system.
Figure 2:
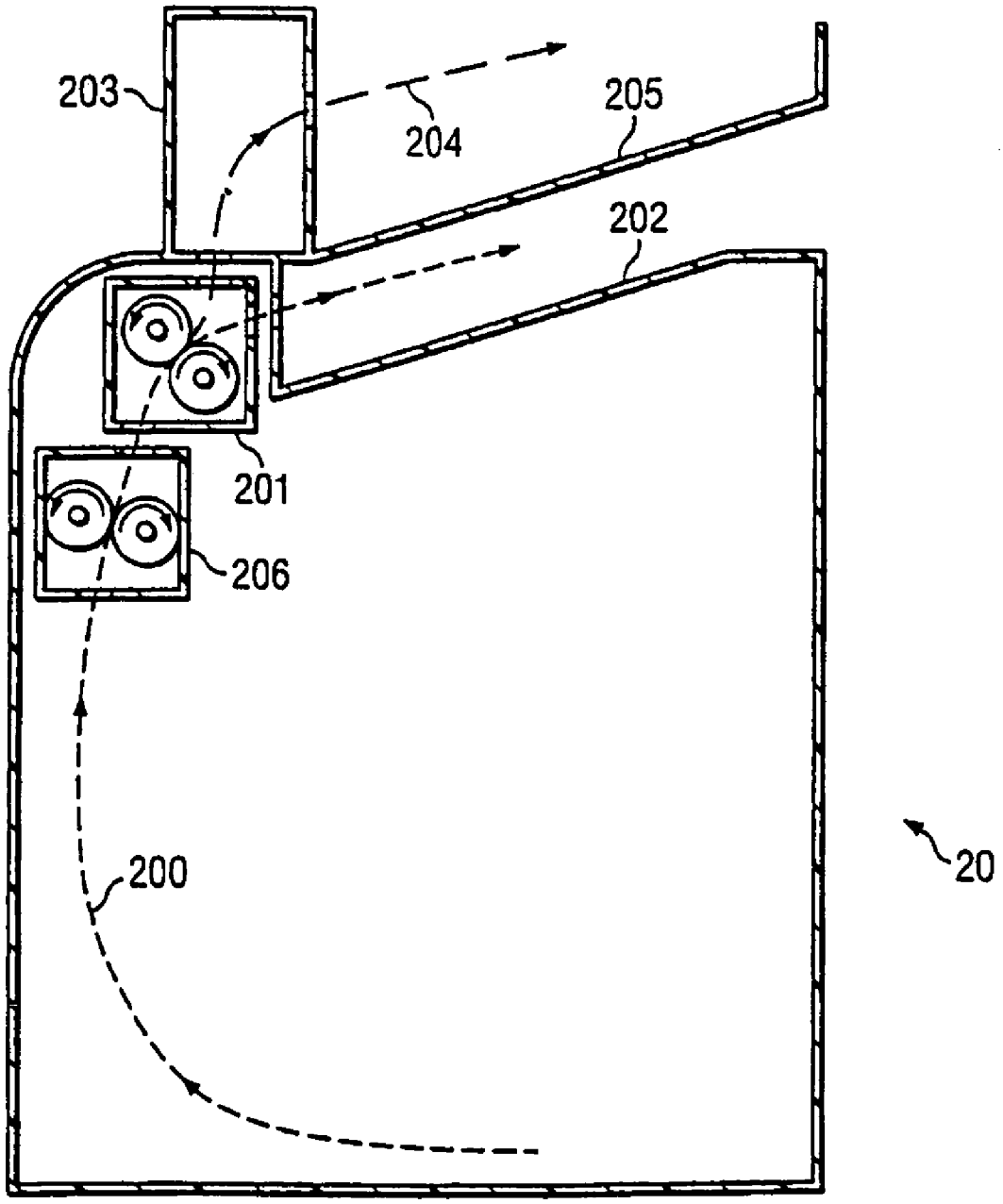
FIG. 2 (PRIOR ART)
FIG. 2 is a side view of a FOFAP with a top-front mounted fuser and a stapler/stacker.
Figure 3:
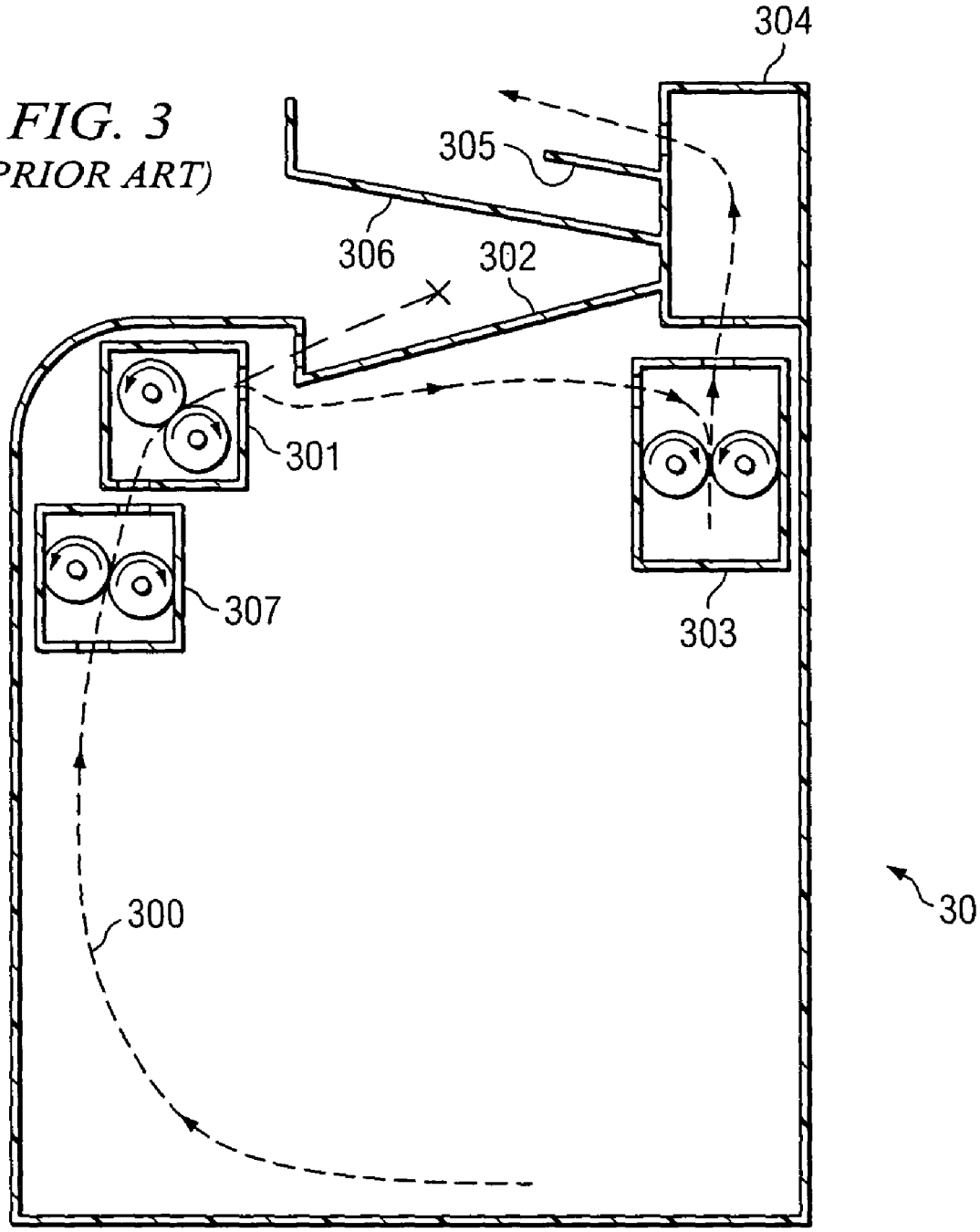
FIG. 3 (PRIOR ART)
FIG. 3 is a side-view of a FOFAP configured with a front-mounted fuser and a rear-mounted flipper and stapler/stacker assembly.

The staple/offset path through stapler/stacker device 404 is essentially unaltered from main paper path 400 except for the diversion through existing media flipper 403 of the duplexing system. There is no efficiency penalty for non-offset/stapled jobs because they generally do not deviate form the original paper path. As such, there is little effect on first page out time for stapled/offset print jobs. Additionally, unlike the existing configurations, the embodiment shown in FIG. 3 uses the existing media flipping capabilities of FOFAP 40 which reduces the costs, complexity, and time to the printing process compared to the printers with additional media flippers.

Furthermore, the user is presented front access to stapled/offset media output without the need to orient FOFAP 40 sideways. Access to primary output bin 402 is also not diminished with the use of folding offset output tray 405. Moreover, because neither folding offset output tray 405 nor primary output bin 402 are bound on the output end by any mechanism, the height or depth of FOFAP 40 does not require significant increase to handle the larger sized paper stock, such as legal, A4, and the like.

Figure 5A:
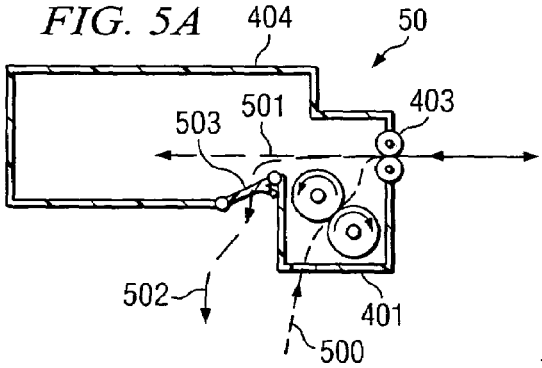
FIG. 5A is a diagram detailing a diverting system for a FOFAP, as shown in FIG. 4.

FIG. 5A is a diagram detailing diverting system 50 of FOFAP 40, as shown in FIG. 4. Diverting mechanism 50 is activated when a staple/offset feature is selected. Print media exits fuser 401 and enters existing media flipper 403. The print media begins exiting FOFAP 40 (FIG. 4) until its trailing edge leaves fuser 401. Once the print media clears fuser 401, media flipper 403 reverses direction drawing the media back into FOFAP 40 (FIG. 4) into duplex printing path 502. However, when the stapler/offset feature is selected diverter 503 is in a closed position re-directing the print media into staple/stacker path 501 into stapler/stacker 404.

Figure 5B:
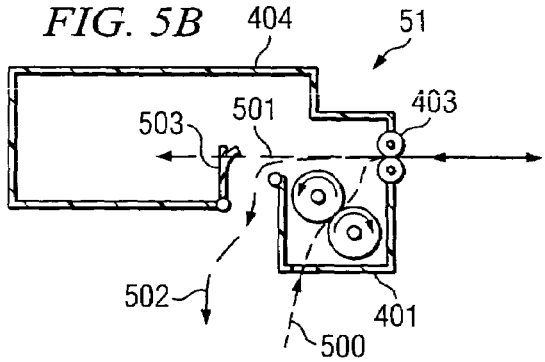
FIG. 5B is a diagram detailing an open diverting system of a FOFAP, as shown in FIG. 4.

FIG. 5B is a diagram detailing open diverting system 51 of FOFAP 40, as shown in FIG. 4. When normal or duplex printing is selected by the user, diverting system 51 remains in an open position. After passing through fuser 401, if duplex operation is selected, the print media is reversed in media flipper 403 and directed down duplex printing path 502. The print media does not get re-directed into stapler/stacker 403 through stapler/stacker path 501 because diverter 503 remains in its open position.

Figure 6A:
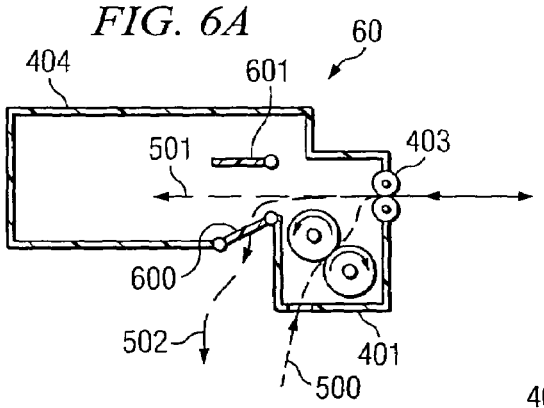
FIG. 6A is a diagram detailing an alternative embodiment of a diverting system for a FOFAP, as shown in FIG. 4.

FIG. 6A is a diagram detailing an alternative embodiment of diverting system 60 for FOFAP 40, as shown in FIG. 4. Diverting mechanism 60 is activated when a staple/offset feature is selected. Print media exits fuser 401 and enters existing media flipper 403. The print media begins exiting FOFAP 40 (FIG. 4) until its trailing edge leaves fuser 401. Once the print media clears fuser 401, media flipper 403 reverses direction drawing the media back into FOFAP 40 (FIG. 4) into duplex printing path 502. However, when the stapler/offset feature is selected gate 600 is in a closed position allowing the print media into staple/stacker path 501 into stapler/stacker 404.

Figure 6B:
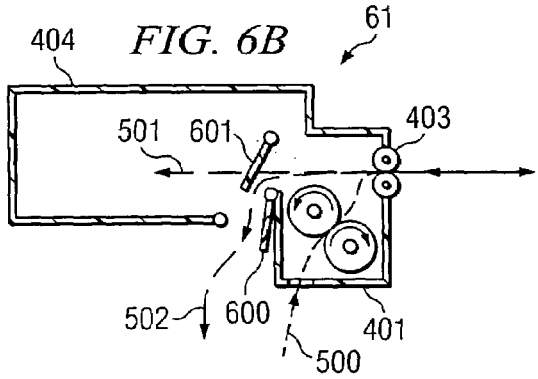
FIG. 6B is a diagram detailing an open diverting system of a FOFAP, as shown in FIG. 4.

FIG. 6B is a diagram detailing open diverting system 61 of FOFAP 40, as shown in FIG. 4. When normal or duplex printing is selected by the user, diverting system 61 remains in an open position. After passing through fuser 401, if duplex operation is selected, the print media is reversed in media flipper 403 and directed down duplex printing path 502. When duplex printing is selected, gate 600 and diverter 601 are moved into a diverting position such that print media does not get re-directed into stapler/stacker 404 through stapler/stacker path 501 because diverter 601 blocks entry to stapler/stacker 404.

It should be noted that, while FIGS. 5 and 6 detail two alternative embodiments of a diverting system, various embodiments of the present invention may be configured with other implementations for diverting the printed media from the duplex path into the stapler/stacker assembly.

Figure 7:
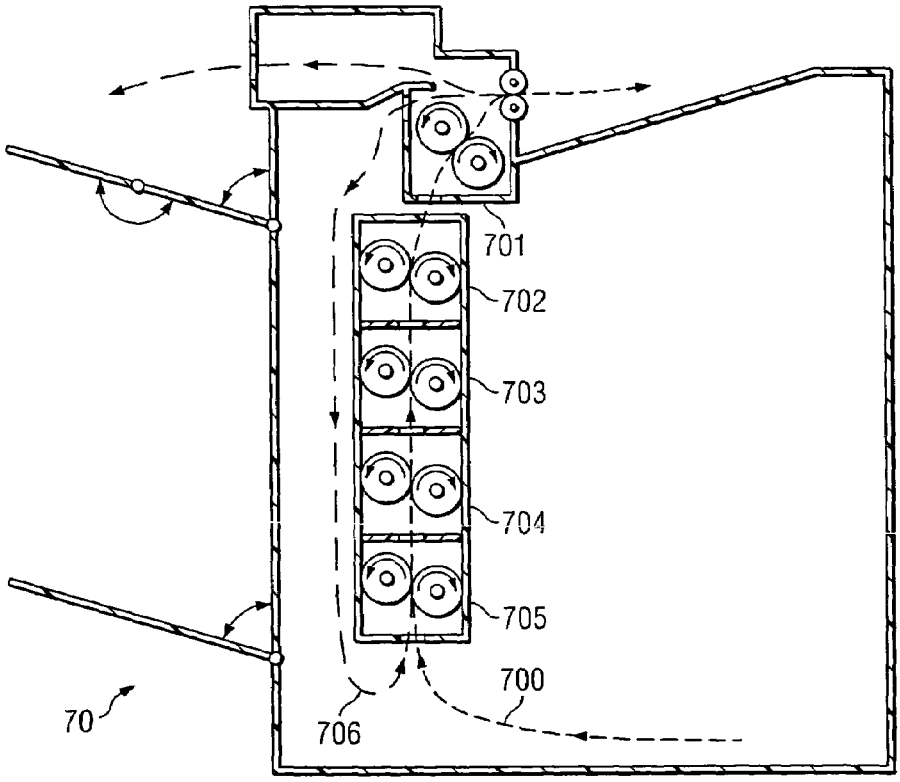
FIG. 7 is a side view of another embodiment of a FOFAP configured with front-mounted color print mechanisms and a front-mounted fusing system.

Also, it should be noted that, while FIG. 4 is shown with a monochrome printer, alternative embodiments of the present invention may be configured on color printers. FIG. 7 is a side view of another embodiment of FOFAP 70 configured with front-mounted color print mechanisms 702–705, and front-mounted fusing system 701. The diverting system of FIG. 7 operates similarly to that shown in FIG. 4 except for the additional ones of color print mechanisms 702–705. Print media on main path 700 and duplex path 706 will pass through color print mechanisms 702–705 to reach front-mounted fusing system 701.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A front-oriented, front-access printer (FOFAP), said FOFAP configured with a front-mounted fuser, said FOFAP comprising:

a print mechanism;

a main paper path passing through each of:

said print mechanism; and said fuser;

a media flipper configured to engage and drive a sheet of media in a first direction along the main paper path and in a second opposite direction towards one of a second path and a third path leading to the stapler/stacker, a stapler/stacker mounted in proximity to said front-mounted fuser; and a redirector within said front-mounted fuser and movable between a first position in which the media sheet moving in the second direction moves along one of the second path and the third path and a second position in which the media sheet moving in the second direction moves along the other of the second path and the third path.

2. The FOFAP of claim 1 further comprising:

a foldable offset tray for holding output from said stapler/stacker, wherein a main output tray is unobstructed when said foldable offset tray is in a folded position.

3. The FOFAP of claim 1 wherein said second path comprises a duplex printing path.

4. The FOFAP of claim 2 wherein said output from said stapler/stacker is stacked in the same orientation as output to said main output tray.

5. The FOFAP of claim 1 wherein said print mechanism is a color print mechanism.

6. A method for redirecting print media in a front-oriented, front-access printer (FOFAP) having a front-mounted fusing apparatus, said method comprising:

directing said print media through a print system;

guiding said print media through a fusing apparatus after said print system along a first media path;

reversing a direction of movement of said print media along the first media path using an existing media engaging and driving member for said path selectively directing the reversed media sheet to one of a second media path and a third media path, wherein the third media path leads to a stapler/stacker.

7. The method of claim 6 further comprising:

depositing output from said front-mounted stapler/stacker assembly in a retractable output tray.

8. The method of claim 6 wherein the second path is a duplex print system path.

9. The method of claim 6 wherein said reversing is done after a trailing edge of said print media exits said fusing apparatus.

10. The method of claim 7 further comprising:

orienting said output in a same direction as completed print jobs in a main output tray.

11. The method of claim 6 wherein said print system is a color print system.

12. A printer having staple/offset stack features, said printer being front-oriented, front-access oriented, said printer comprising:

printing means;

fusing means mounted in a front area of said printer;

media flipping means for engaging a print media and reversing a direction of movement of said print media along a first printing path;

stacking means mounted in a front side of said printer for accumulating said print media pending execution of a staple/offset function; and redirection means for selectively directing said reversed print media into a second path or a third path leading to said stacking means in response to selection of said staple/offset stack capability.

13. The printer of claim 12 further comprising:

retracting means associated with an offset output tray, wherein said offset output tray does not obstruct a main output tray when said retracting means is activated.

14. The printer of claim 12 wherein said second printing path is a duplex printing path.

15. The printer of claim 12 further comprising:

output means for outputting print media from said stacking means in a same orientation as print media output to a main output tray.

16. The printer of claim 12 wherein said printing means comprise color printing means.

17. An apparatus comprising:

a printing mechanism configured to print upon a medium;

an output tray;

a stacker configured to stack printed upon media;

a media driver configured to engage and move printed upon media along a first path in a first direction to the output tray and configured to engage and move printed upon medium along the first path in a second opposite direction towards one of a second path and a third path leading to the stacker; and a director movable between a first position in which media being driven by the media driver in the second direction is directed into the second path and a second position in which media being driven by the media driver in the second direction is directed into the third path.

* * * * *

UNITED STATES PATENT AND TRADEMARK OFFICE

CERTIFICATE OF CORRECTION

PATENT NO. : 7,133,640 B2
APPLICATION NO. : 10/629398
DATED : November 7, 2006
INVENTOR(S) : Sarah Zeller et al.

It is certified that error appears in the above-identified patent and that said Letters Patent is hereby corrected as shown below:

In column 6, line 32, in Claim 1, delete “stapler/stacker,” and insert -- stapler/stacker; --, therefor.

Signed and Sealed this

Thirtieth Day of December, 2008

JON W. DUDAS
*Director of the United States Patent and Trademark Office*